US006035487A

United States Patent [19]

Simon

[11] Patent Number: 6,035,487

[45] Date of Patent: Mar. 14, 2000

[54] UNIVERSAL DOOR STOP

[75] Inventor: Ira J. Simon, Long Beach, Calif.

[73] Assignee: Triangle Brass Manufacturing Co., Los Angeles, Calif.

[21] Appl. No.: 09/172,181

[22] Filed: Oct. 13, 1998

[51] Int. Cl.[7] ..... E05F 5/06

[52] U.S. Cl. ..... 16/86 R; 16/86 A

[58] Field of Search ..... 16/86 R, 86 A, 16/82; 292/DIG. 15, 341.12, 341.15, DIG. 17

[56] References Cited

U.S. PATENT DOCUMENTS

| | | | |
|---|---|---|---|
| 913,748 | 3/1909 | Mefford . | |
| 1,128,105 | 2/1915 | Cheston . | |
| 1,299,416 | 4/1919 | Atwood . | |
| 1,533,687 | 4/1925 | Beck et al. . | |
| 1,627,825 | 5/1927 | Beck et al. . | |
| 1,657,313 | 1/1928 | Mitchell . | |
| 1,858,541 | 5/1932 | Duffy . | |
| 2,311,278 | 2/1943 | Johnson | 16/86 A |
| 2,517,966 | 8/1950 | Boye | 292/73 |
| 2,617,140 | 11/1952 | Desy | 16/86 |
| 2,715,242 | 8/1955 | Smith | 16/86 A |
| 2,899,703 | 8/1959 | Johnson | 16/86 |
| 2,988,392 | 6/1961 | Chi Sheng Kuo | 292/338 |
| 3,010,142 | 11/1961 | Ahlquist | 16/86 A |
| 3,864,785 | 2/1975 | Hoppock | 16/86 A |
| 4,209,876 | 7/1980 | Wilzig et al. | 16/82 |
| 4,505,502 | 3/1985 | Tomita | 292/251.5 |
| 5,335,396 | 8/1994 | Dolan | 16/82 |
| 5,799,367 | 9/1998 | Simon et al. | 16/86 A |
| 5,836,049 | 11/1998 | Chiang | 16/86 A |

FOREIGN PATENT DOCUMENTS

| | | | |
|---|---|---|---|
| 1363837 | 5/1964 | France . | |
| 6-229166 | 8/1994 | Japan | E05F 5/06 |
| 298431 | 10/1928 | United Kingdom . | |

OTHER PUBLICATIONS

"Universal Floor Bumper", Baldwin Hardware Corporation, Reading, PA.

*Primary Examiner*—Chuck Y. Mah
*Attorney, Agent, or Firm*—D'Alessandro & Ritchie

[57] ABSTRACT

A door stop having a retaining member having a shell defining a cavity, and a ledge extending outwardly from a lower portion of the shell, and an elastomeric bumper received in the shell cavity and having an exposed front surface, with the ratio of the length of the exposed bumper front surface to the thickness of the ledge is greater than about 8.0.

8 Claims, 4 Drawing Sheets

UNIVERSAL DOOR STOP

BACKGROUND OF THE INVENTION

1. Field of the Invention

The present invention relates to door stops, and more particularly to the exposed area of an elastic bumper in the stops.

2. The Background Art

Door stops are frequently used with doors in a number of configurations. One type of door stop is secured to the floor, and contacts a door when it is opened a desired distance to prevent the door from striking a wall or other obstruction behind the stop. Three commercially available door stops are shown in FIGS. 1–6. One such door stop is illustrated in FIGS. 1 and 2, another door stop is shown in FIGS. 3–5, and a further door stop is shown in FIG. 6 is in accordance with the door stop shown in U.S. Pat. No. 4,209,876.

The prior door stops 10 have a metal retaining member 12 having a shell 14 defining a cavity, and a ledge 16 extending outwardly from a lower portion of the shell 14. The stops 10 have an elastomeric bumper 18 projecting outwardly from the shell 14, with the bumpers 18 defining an elastomeric front surface 20 of the bumper 18 for contacting the door when it is opened. The door stops 10 each have a post 21 depending from the shell 14, and a hole in the ledge 16 to receive a screw or other fastener. When it is desirable to attach the stop 10 to the floor, two spaced holes are drilled into the floor, the post 21 is placed in one of the holes, and a screw is generally applied through the ledge 16 into the floor in order to attach the door stop 10 to the floor.

Within a building, the transition in the type of flooring typically takes place at the doorway from one room to another. The transition from flooring types generally results in a variation in the elevation of the floor within the doorway. In order to accommodate this change in flooring elevation, the door must be cut at the bottom to allow it to swing freely over the flooring. The door stop 10 of FIGS. 1 and 2 is designed to be used in conjunction with flooring which is of a different elevation on either side of the doorway. The taller ledge 16 of this top configuration is designed to make contact with a door with a bottom edge which has been cut to allow the door to swing freely over the higher elevation flooring, such as the instance where the door swings over a tile floor but meets carpeting in the doorway. The door stop 10 of FIGS. 3 and 4 is designed for use on a non-carpeted floor on both sides of the doorway, which does not necessitate removing material from the bottom of the door. Under this circumstance, ledge 16 must be at a low elevation so that the door swings over ledge 16 making contact with elastomeric front surface 20 at a lower elevation.

Unfortunately, the building plans generated by architects do not always indicate what type of flooring is to be applied in each room. As a consequence, the subject door stops supplied to the builder are very frequently not of the appropriate configuration. In those instances where a door stop of the FIG. 1 configuration is required and the builder has been supplied with a FIG. 3 door stop, a lower spacer 22, is traditionally supplied as shown in FIG. 5. This lower spacer 22, when applied under the door stop illustrated in FIG. 3, increases the elevation of ledge 16 to that of the door stop illustrated in FIG. 1.

The economics of exchanging the FIG. 1 stop are highly undesirable as are the economics of the converse. The economics of supplying lower spacer 22 are poor as well. Unfortunately neither of the stops described will allow a single stop to be utilized for all of the floor configurations previously described, without the use of lower spacer 22 which is typically supplied once floor conditions are known.

This highly costly and inefficient situation has persisted without improvement for decades.

As a result of the construction of the stops 10 for different types of floors, it has been found that the exposed bumper surface area of these stops 10 is inadequate to permit use of either stop 10 alone on carpeted and non-carpeted floors. For example, the stop of FIGS. 1 and 2 has an exposed area of the bumper 18 having a length of approximately 0.8 inches, and a thickness of the ledge 16 of approximately 0.4 inches. This stop 10 has a ratio of the length of the exposed front surface of the bumper 18 generally perpendicular to the floor to the thickness of the ledge 16 of approximately 2.0 in which the ratio is a measure of the efficiency of the stop 10 since for an increasing ratio, the length of the exposed bumper surface is maximized, and/or the thickness of the ledge 16 is minimized. The stop 10 of FIGS. 3–5 has a length of an exposed surface of the bumper 18 of approximately 0.9 inches, and a thickness of the ledge 16 of approximately 0.2 inches. For this stop 10, the ratio of the length of the exposed bumper surface area to the thickness of the ledge 16 is approximately 4.5. For the commercial stop 10 of FIG. 6, the length of the exposed front surface of the bumper 18 is approximately 0.5 inches, the thickness of the ledge 16 is approximately 0.2 inches, and the ratio of the length of the exposed bumper surface to the thickness of the ledge 16 is approximately 2.5.

It would be immensely desirable to have a door stop similar to those previously described where one door stop configuration would accommodate the entire variety of flooring conditions outlined earlier. By enlarging the exposed height of the bumper 18 and the corresponding ratio of the length of the exposed bumper surface to the thickness of the ledge 16 to provide a door stop that meets this requirement and eliminates the need for a lower spacer 22.

BRIEF DESCRIPTION OF THE INVENTION

The present invention relates to a door stop having a retaining member having a shell defining a cavity, and a ledge extending outwardly from a lower portion of the shell. The door stop has an elastomeric bumper received in the shell cavity and having an exposed front surface. In a presently preferred embodiment of the invention, the ratio of the length of the exposed bumper front surface to the thickness of the ledge is greater than about 8.0, and preferably about 11.0. In addition, the length of the exposed bumper surface is about 1.1 inches.

As a result, the door stop of the present invention may be used on either carpeted or non-carpeted floors, and eliminates the necessity of maintaining an inventory of different stops, or the necessity of the use of separate spacers for any of the stops.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

Figure 7:
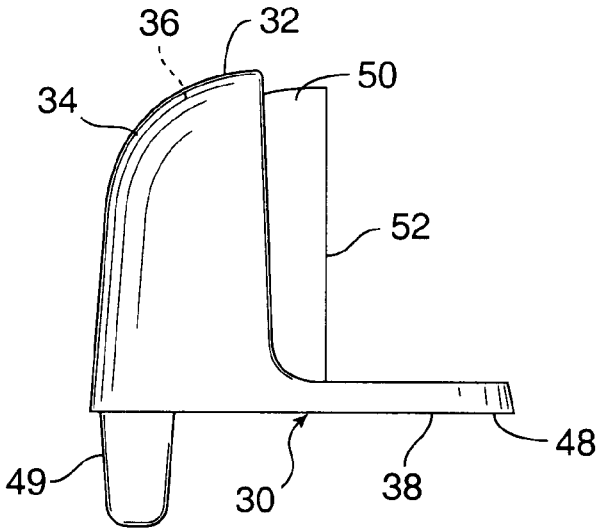
FIG. 7 is a side elevational view of a door stop in accordance with a presently preferred embodiment of the present invention.
Figure 8:
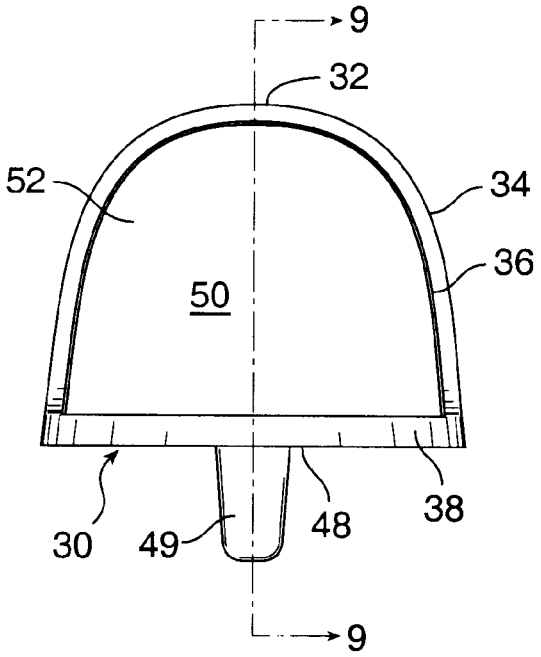
FIG. 8 is a front elevational view of the door stop of FIG. 7.
Figure 9:
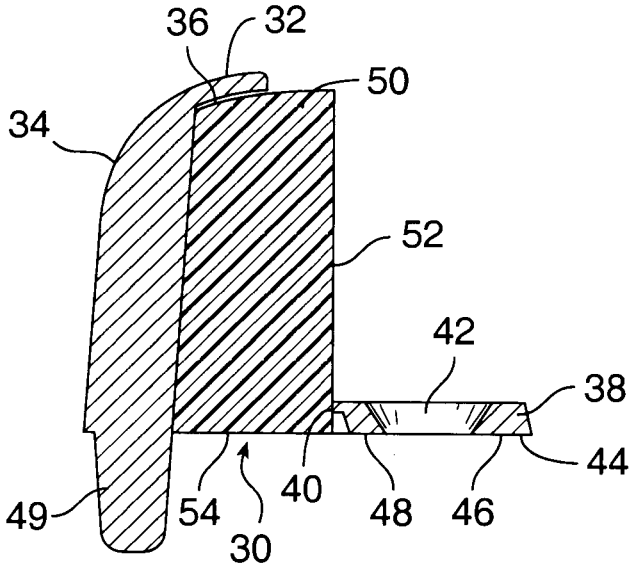
FIG. 9 is a sectional view taken substantially as indicated along the line 9—9 of FIG. 8.
Figure 10:
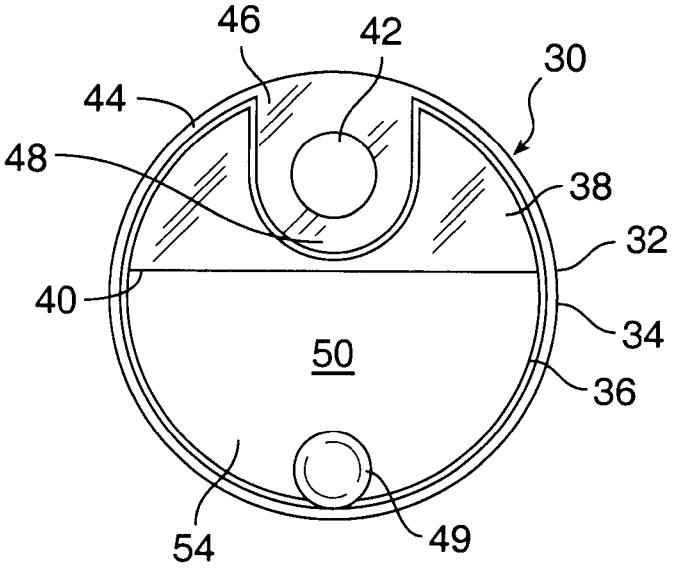
FIG. 10 is a lower plan view of a door stop in accordance with FIG. 7.

Referring now to FIGS. 7–10, there is shown a door stop generally designated 30 of the present invention. The door stop 30 has a retaining member 32 which may be constructed from a rigid material, such as a metal or a rigid plastic material. The retaining member 32 has a shell 34 defining a cavity 36, and a ledge 38 extending outwardly from a lower portion of the shell 34.

The ledge 38 has an inner edge 40 directed towards the cavity 36, and an opening 42 to receive a screw (not shown). The ledge 38 has a lower outer rim 44 extending about an outer edge of the ledge 38. The ledge 38 also has a lower raised portion 46 having a lower surface 48 which is flush with a lower end of the rim 44. The stop 30 also has a post 49 depending from the shell 34 for a purpose which will be described below.

The door stop 30 has a bumper 50 which may be constructed from an elastomeric material, such as rubber. The bumper 50 is received in the cavity 36 of the shell 34, such that the bumper 50 has an exposed front surface 52, and a lower surface 54 located below the inner edge 40 of the ledge 38. In this configuration, the inner edge 40 of the ledge 38 is positioned over the front surface 52 of the bumper 50. Also, in a presently preferred embodiment of the present invention, the lower surface 48 of the raised portion 46 is approximately flush with the lower surface 54 of the bumper 50.

In use of the door stop 30 of the present invention, two holes are drilled into a floor in the vicinity of a door, and the post 49 is placed in one of the holes. At this time, a screw or other fastener is placed though the opening 42 of the ledge 38, and is driven into the floor in order to secure the door stop 30 securely to the floor.

Figure 1:
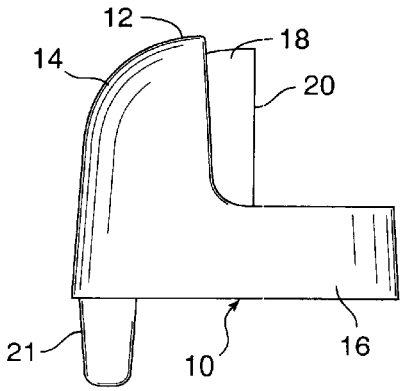
FIG. 1 PRIOR ART
FIG. 1 is a side elevational view of a door stop of the prior art.
Figure 2:
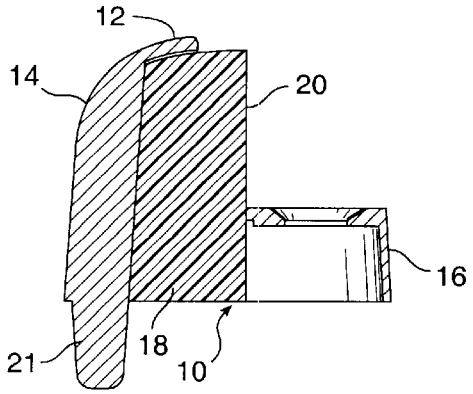
FIG. 2 PRIOR ART
FIG. 2 is a sectional view of the door stop of FIG. 1.
Figure 3:
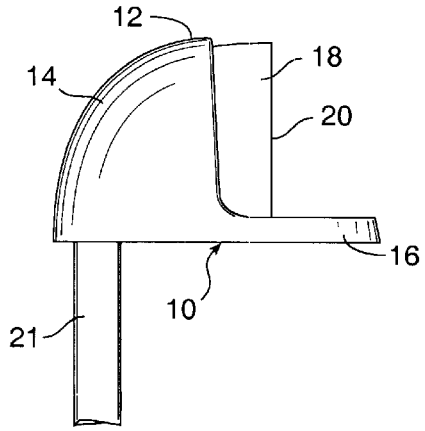
FIG. 3 PRIOR ART
FIG. 3 is a side elevational view of another door stop of the prior art.
Figure 4:
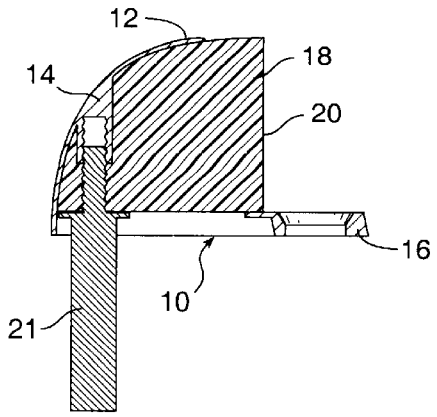
FIG. 4 PRIOR ART
FIG. 4 is a sectional view of the door stop of FIG. 3.
Figure 5:
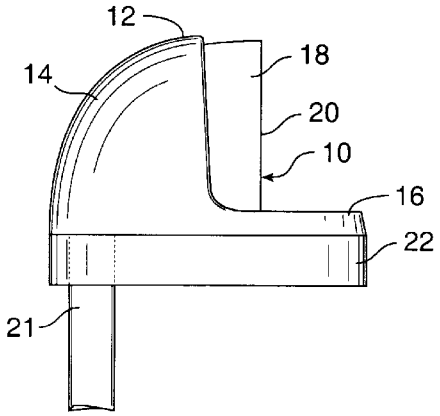
FIG. 5 PRIOR ART
FIG. 5 is a side elevational view showing use of a spacer on the door stop of FIG. 3.
Figure 6:
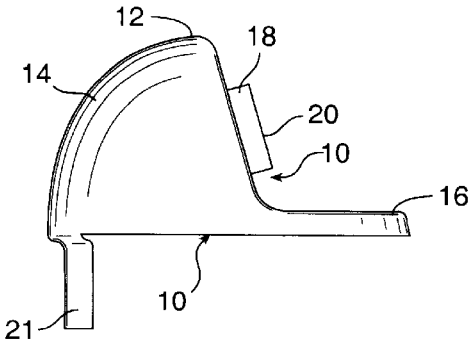
FIG. 6 PRIOR ART
FIG. 6 is a side elevational view of another door stop of the prior art.

In accordance with a presently preferred embodiment of the present invention, the length of the exposed front bumper surface or exposed bumper height 52 is approximately 1.1 inches, and is preferably greater than about 0.9 inches. In this manner, a greater surface area of the bumper 50 is exposed for improved use of the door stop 30. The thickness of the ledge 38 is about 0.1 inches. The ratio of the exposed length of bumper front surface 52 to the thickness of the ledge 38 is preferably greater than 8.0. This ratio is an indication of the efficiency of the door stop 30 in presenting an exposed bumper 50 to block the door when it is opened. in accordance with a presently preferred embodiment of the present invention, the above ratio is about 11.0, which is almost double this ratio in the disclosed prior art previously discussed in connection with FIGS. 1–6.

As a result, the door stop 30 of the present invention may be used on all types of floors, such as carpeted and non-carpeted floors. There is no longer a need to maintain an inventory of different stops, or the use of a spacer with a given stop. Thus, the door stop 30 of the present invention reduces the cost of use of the door stops for placement in a building, and simplifies the attachment procedure of the door stop.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A door stop adapted for mounting on a floor comprising:

a retaining member having a ledge and a shell, said ledge having a floor-engaging surface and an inner edge disposed between said floor-engaging surface and a ledge top surface disposed a first distance x above and parallel to said floor-engaging surface, said shell disposed vertically upward from said ledge and defining a cavity having a cavity opening, and wherein said ledge top surface is disposed to avoid inhibiting movement of a door intended for one of either a carpeted floor surface or a non-carpeted floor surface; and an elastomeric bumper received in said cavity extending outwardly through said cavity opening, said bumper having an exposed front surface extending upwardly from said ledge top surface a second distance y above said ledge top surface, wherein said second distance divided by said first distance yields a ratio of y:x exceeding about 8.

2. The stop in claim 1 wherein said ratio is about 11.

3. The stop in claim 1 wherein said first distance x is about 0.1 inch.

4. The stop in claim 1 wherein said second distance y exceeds about 0.9 inch.

5. The stop in claim 1 wherein said second distance y is about 1.1 inches.

6. The stop in claim 1 wherein said ledge further comprises an aperture therethrough between said ledge top surface and said floor-engaging surface to receive a floor-mounting device.

7. The stop in claim 12 wherein said retaining member further comprises a post adapted to be received into an opening on a floor-surface.

8. A door stop adapted for mounting on a floor, comprising:

a retaining member having a ledge and a shell, said ledge having a floor-engaging surface and an inner edge disposed between said floor-engaging surface and a ledge top surface disposed a first distance x above and parallel to said floor-engaging surface, said shell disposed vertically upward from said ledge and defining a cavity having a cavity opening, wherein said first distance x is equal to about 0.1 inch; and an elastomeric bumper received in said cavity having a lower surface approximately flush with said floor-engaging surface of said ledge, a front portion extending outwardly from said cavity opening, and an exposed front surface engaging said inner edge, wherein said exposed front surface extends upwardly from said ledge top surface a second distance y above said ledge top surface, wherein said elastomeric bumper extends a third distance z above said lower surface, wherein said third distance z is approximately equal to said first distance x plus said second distance y, and wherein and said third distance z divided by said second distance y yields a ratio of z:y of between 1.10 and 1.12.

* * * * *